United States Patent [19]

Clark

[11] Patent Number: 4,646,999

[45] Date of Patent: Mar. 3, 1987

[54] SUPPORT FOR MOUNTING GROOMING ITEMS ON THE OUTSIDE OF CANS CONTAINING GROOMING PRODUCTS

[76] Inventor: Douglas A. Clark, 713 W. Hermosa Dr., Tempe, Ariz. 85282

[21] Appl. No.: 717,959

[22] Filed: Mar. 29, 1985

Related U.S. Application Data

[63] Continuation-in-part of Ser. No. 679,935, Dec. 10, 1984, abandoned.

[51] Int. Cl.[4] ..... A47G 29/00

[52] U.S. Cl. ..... 248/360; 248/110

[58] Field of Search ..... 248/359 R, 360, 312.1, 248/110; 211/65, 66, 13, 60 R; D6/526, 528, 530, 534; 222/182; 206/228

[56] References Cited

U.S. PATENT DOCUMENTS

| | | | |
|---|---|---|---|
| D. 155,372 | 9/1949 | Whitman | D6/528 |
| D. 185,182 | 5/1959 | Wise | D6/526 |
| D. 185,776 | 7/1959 | Renn et al. | D6/528 |
| D. 228,993 | 11/1973 | Jackson | D6/526 |
| D. 234,175 | 1/1975 | Schellhouse | D6/526 |
| D. 254,881 | 5/1980 | Pyskaty | D6/526 |
| 971,818 | 10/1910 | Barker | 248/110 X |
| 1,053,190 | 2/1913 | Lyon | 248/359 R X |
| 2,957,596 | 10/1960 | Rehborg | 248/359 R X |
| 3,961,729 | 6/1976 | Grimm | 248/359 R X |
| 4,071,218 | 1/1978 | Pecka | 248/312.1 X |
| 4,141,445 | 2/1979 | Korich | 211/13 X |

OTHER PUBLICATIONS

"American Home", published Nov. 1952, p. 31.

*Primary Examiner*—J. Franklin Foss
*Attorney, Agent, or Firm*—Warren F. B. Lindsley

[57] ABSTRACT

An article of manufacture for supporting a grooming item such as a safety razor, toothbrush or the like on the outer periphery of an elongated container containing grooming material, whereby the head of the item is supported by hook means near or on the cap of the container and the handle of the item is positioned to extend along and juxtapositioned to the outside periphery of the container.

9 Claims, 21 Drawing Figures

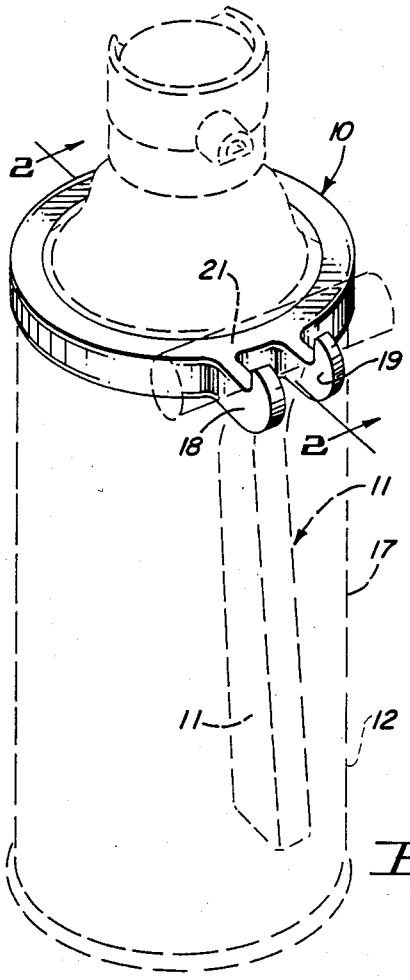
FIG. 1
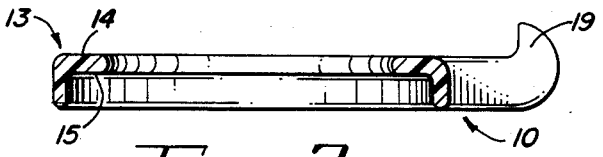
FIG. 2
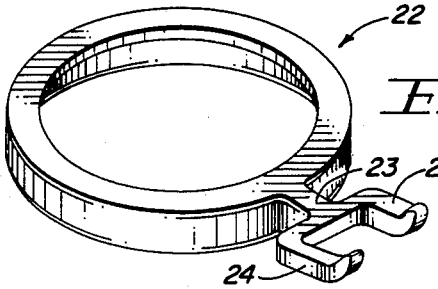
FIG. 5
FIG. 6
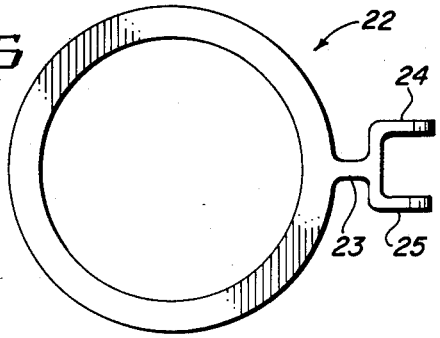
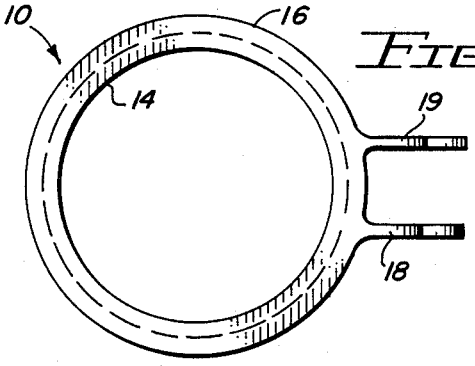
FIG. 3
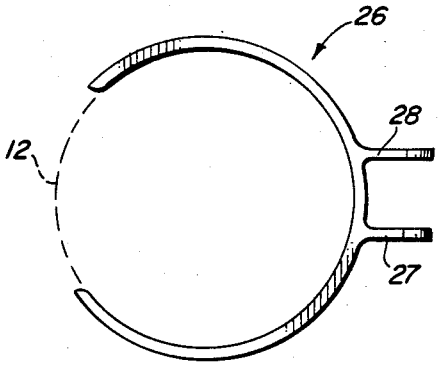
FIG. 8
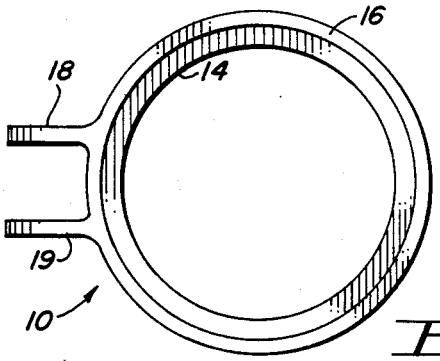
FIG. 4
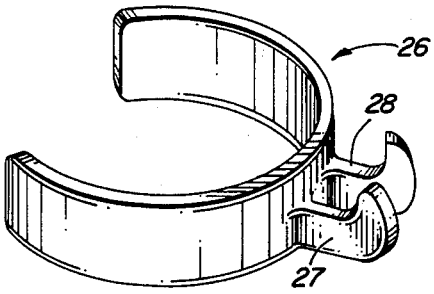
FIG. 7

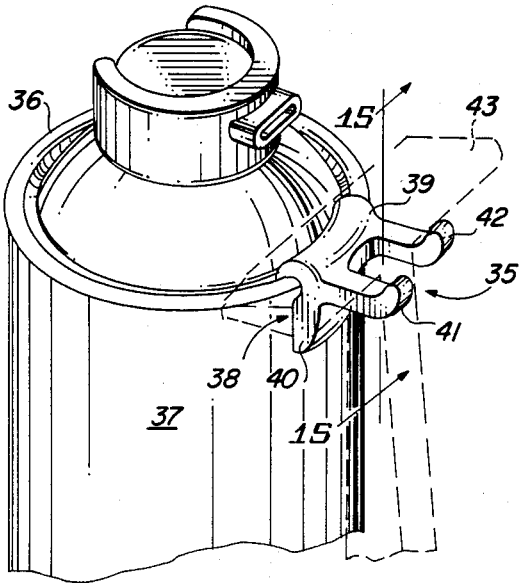
FIG. 14
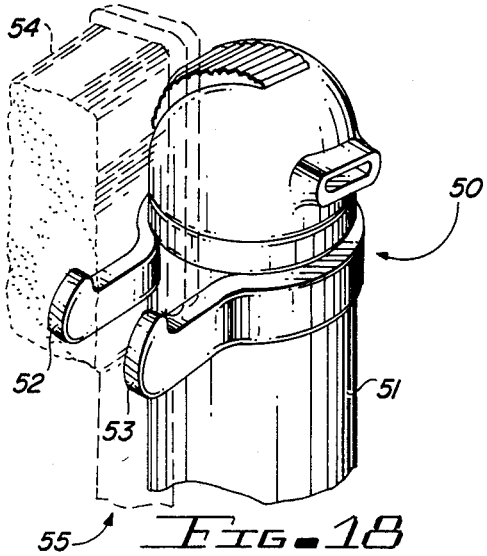
FIG. 18
FIG. 15
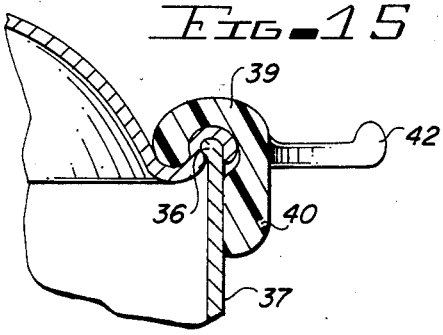
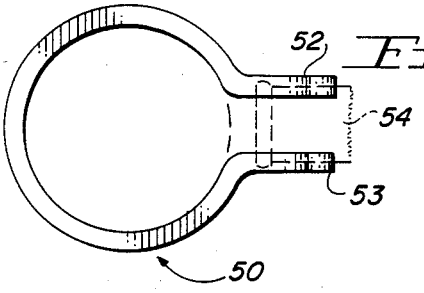
FIG. 19
FIG. 16
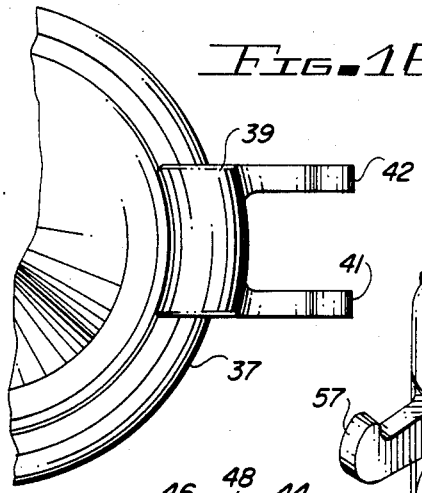
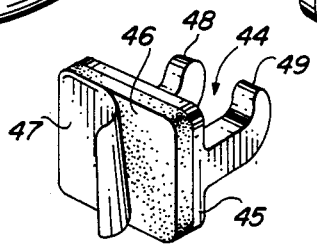
FIG. 17
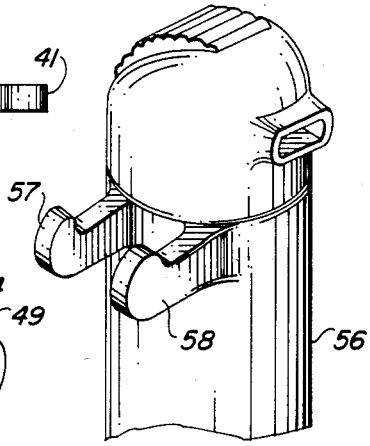
FIG. 20
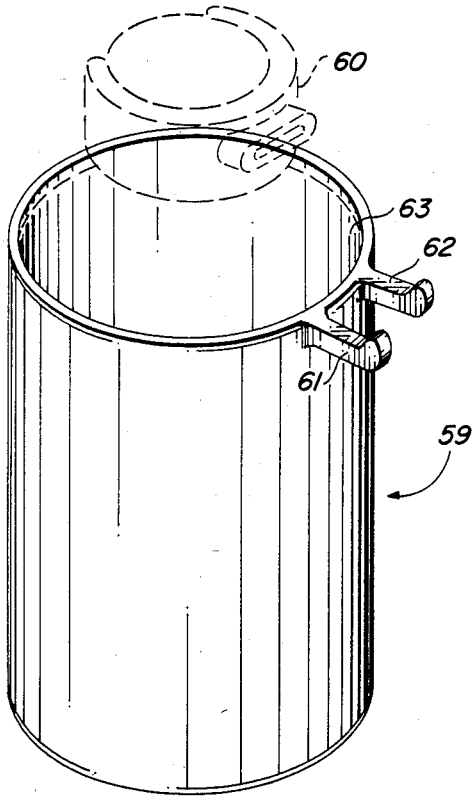
FIG. 21

SUPPORT FOR MOUNTING GROOMING ITEMS ON THE OUTSIDE OF CANS CONTAINING GROOMING PRODUCTS

BACKGROUND OF THE INVENTION

This application is a continuation in part of U.S. patent application Ser. No. 06/679,935, now abandoned, filed Dec. 10, 1984 and entitled SUPPORT FOR MOUNTING GROOMING ITEMS ON THE OUTSIDE OF CANS CONTAINING GROOMING PRODUCTS.

This invention relates to grooming products such as pressurized shaving cream, deodorant and hair spray containers, and more particularly to a means attached thereto which will support therefrom a grooming item such as a safety razor or toothbrush when not in use.

It is well recognized that safety razors and toothbrushes after use must be stored in a convenient place until needed again. In many instances, they are washed off and placed in a drawer of the bathroom counter or simply left on its top with associated grooming products. Storing a wet safety razor or toothbrush, for example, in a drawer or leaving it in a disarray with other grooming items on the top of a counter leaves a lot to be desired.

Thus, a means is needed which will store these grooming items in an easily accessible place with associated grooming products which means will permit them to quickly air dry and yet provide an orderly association of it with the other grooming products.

SUMMARY OF THE INVENTION

In accordance with the invention claimed, a new and improved device is provided for storing a safety razor or toothbrush with associated grooming products.

It is, therefore, one object of this invention to provide a means for attaching a safety razor or toothbrush to a grooming product.

Another object of this invention is to provide a new and improved device for detachably affixing a safety razor or toothbrush to a can of a grooming product.

A further object of this invention is to provide a new and improved arcuate-shaped device for at least partially surrounding a can of grooming products for supporting a safety razor, toothbrush and the like when they are not in use.

A still further object of this invention is to provide a new and improved ring detachably mounted on a can containing a grooming product for supporting a safety razor, toothbrush or the like.

A still further object of this invention is to provide a new and improved clip on hook for mounting on the rim of cans of grooming products for supporting a safety razor, toothbrush or the like.

A still further object of this invention is to provide a new and improved adhesively held hook means for applying to any container of a grooming product for supporting when not in use a safety razor, toothbrush or the like.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which:

FIG. 1 is a perspective view of a ring-like device for detachably mounting on a shaving cream can for supporting a safety razor, toothbrush or the like when not in use;

FIG. 2 is a cross-sectional view of FIG. 1 taken along the line 2—2;

FIG. 3 is a top plan view of the ring-like device shown in FIG. 1;

FIG. 4 is a bottom view of FIG. 3;

FIG. 5 is a perspective view of a modification of the ring-like device shown in FIGS. 1–4;

FIG. 6 is a bottom view of FIG. 5;

FIG. 7 is a perspective view of a further modification of the ring-like device shown in FIGS. 1–6;

FIG. 8 is a top view of FIG. 7 showing it surrounding a part of a supporting can;

FIG. 14 is a perspective partial view of a can of a grooming product having a clip on hook means secured to its rim for supporting a safety razor, toothbrush or the like when not in use;

FIG. 15 is a cross-sectional view of FIG. 14 taken along the line 15—15;

FIG. 16 is a top view of the hook means shown in FIG. 14;

FIG. 17 is a modification of the hook means shown in FIG. 14–16 which is provided with an adhesive back for attaching to a can of a grooming product;

FIG. 18 is a perspective view of further modification of an arcuate ring-shaped hook means clamped on a pressurized can of toothpaste for supporting a toothbrush when it is not in use;

FIG. 19 is a top view of the hook means shown in FIG. 18;

FIG. 20 is a partial perspective view of a pressurized can of a grooming product with the hook means formed integral with the can; and FIG. 21 is a perspective view of a cylindrical cup-like container for supporting therein a can of grooming products with a hook means for supporting a razor or toothbrush when not in use formed integral therewith along its upper rim.

DESCRIPTION OF THE PREFERRED EMBODIMENT

Figure 9:
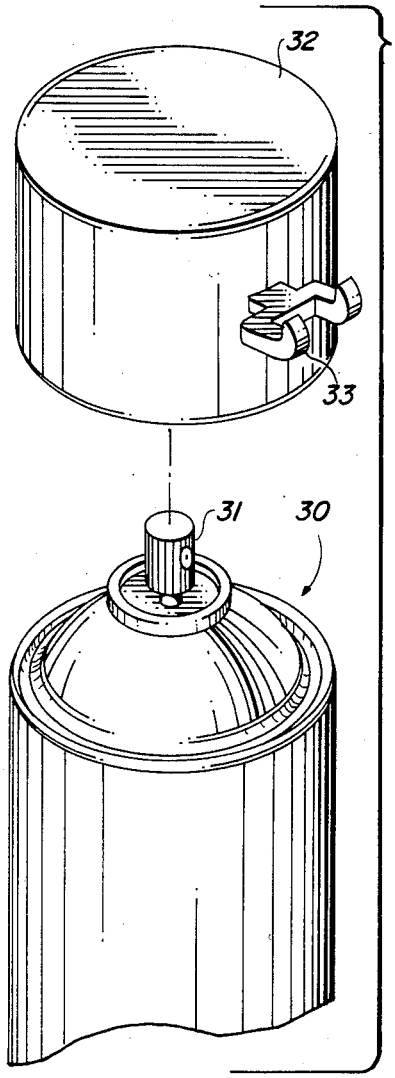
FIG. 9 is a perspective exploded view of a further can configuration wherein the attachment means for supporting a safety razor or toothbrush is attached to its cap.

Referring more particularly to the drawings by characters of reference, FIGS. 1–4 disclose a ring-shaped attachment means 10 for supporting a grooming appliance or item such as a safety razor 11 on a can 12 (pressurized or not) of shaving cream or other grooming material when the safety razor is not in use. Although a safety razor is shown, other grooming items such as a toothbrush may be supported by the attachment means and still fall within the scope of this invention. As shown in FIGS. 2–4, the ringshaped means has an L-shaped cross-sectional configuration 13 with its lip 14 fitting over the top edge or rim 15 of the can and the remainder 16 of the ring extending downwardly along the outer surface 17 of the can.

A pair of spacedly positioned shank supported hooks 18 and 19 of a common length are formed integrally with the ring at a position along its outer periphery for receiving therebetween the handle 20 of the safety razor with the head 21 of the safety razor extending between and across the top surface of the hooks as shown in FIG. 1.

Thus, when not in use, the safety razor can be mounted and stored on the can with its handle juxtapositioned to and extending along the length of the can.

FIGS. 5 and 6 disclose a modification of the ring-shaped attachment means 10 shown in FIGS. 1–4, wherein the ring 22 comprises a solid structure having a square or rectangular cross-sectional configuration with an arm 23 extending outwardly of its periphery which branches out in a U-shaped configuration to provide a pair of arms or shank supported hooks 24 and 25 of a common length which receive therebetween the handle 17 of the safety razor and support on their top surfaces the head 21 of the safety razor in the manner shown in FIG. 1.

In this instance, the ring can be supported on the rim of the can without overlapping its outer surface in the manner shown in FIG. 1.

FIGS. 7 and 8 disclose an arcuate configuration comprising a partial ring formed of a resilient material for fitting around the outer configuration of a can or its cap for holding and storing a safety razor in the manner shown in FIG. 1.

This ring 26 comprising an arcuate configuration of more than 180 degrees, but less than 360 degrees, may be snapped into place around the periphery of a can 12 of grooming material or its cover or it may be slid over one end of the can until it snugly engages the periphery of the can. A pair of spacedly positioned hooks 27 and 28 integrally formed with the ring support a safety razor in the manner shown in FIG. 1.

It should be recognized that rings 10, 22 and 26 may be formed of any suitable material, such as a metal or plastic, and still fall within the scope of this invention. The ends of the hook means forming a part of each ring are curved laterally of the shank of each hook in an upward direction when the rings are mounted on a can to cradle the head of the safety razor or toothbrush between the ends of the hooks and the can to keep the safety razor from falling off of the can.

Figure 10:
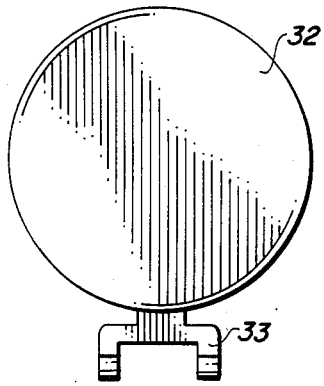
FIG. 10 is a top view of the cap shown in FIG. 9.

FIGS. 9 and 10 illustrate a can 30, such as a pressurized container of a grooming material, which is dispensed by a suitable nozzle means 31. This can is provided with a cover 32 to which is integrally affixed a hook means 33 for supporting the safety razor or toothbrush in the manner shown in FIG. 1.

Figure 11:
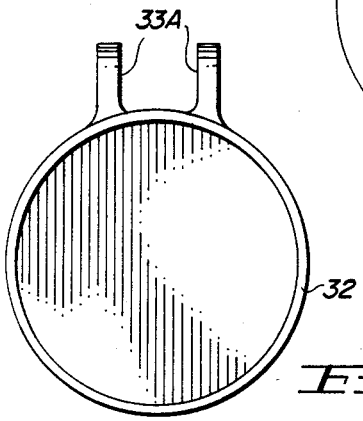
FIG. 11 is a bottom view of a modification of FIG. 10.
Figure 12:
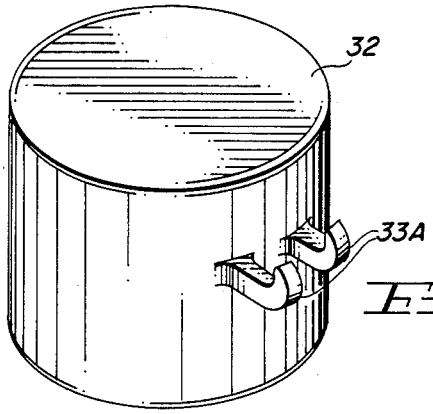
FIG. 12 is a perspective view from the top of FIG. 11.

FIGS. 11 and 12 illustrate the cover 32 shown in FIGS. 9 and 10 employing a modification of the hook means 33 shown thereon. As shown in FIGS. 11 and 12, hook means 33A comprises a pair of prongs of like size and shape which form a cradle for supporting the head of a safety razor or toothbrush therebetween in the manner discussed above.

Figure 13:
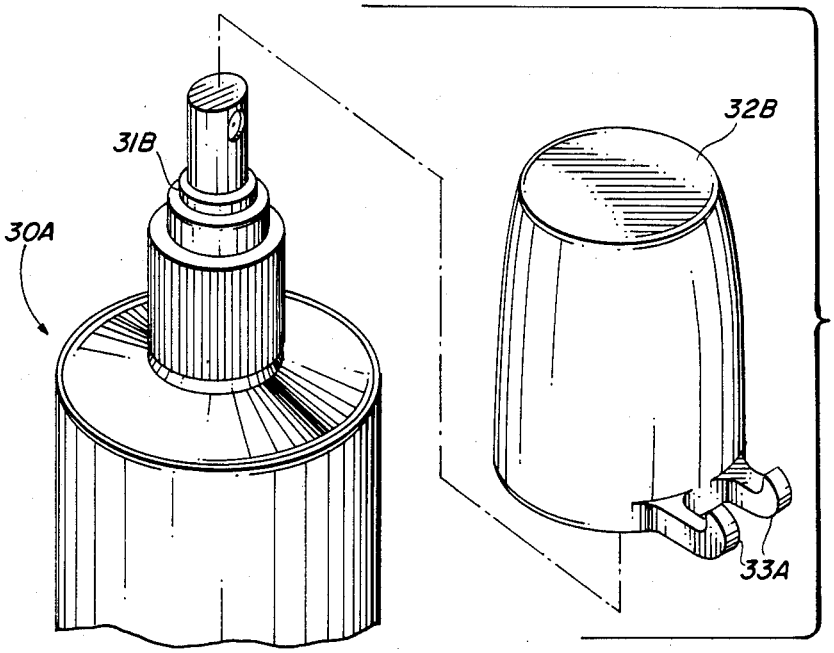
FIG. 13 is a further embodiment of a nonpressurized pump container and cap embodying the invention.

FIG. 13 discloses a container or can 30A of a non-pressurized material such as liquid soap which is dispensed therefrom by a pump 31B in a manner well known in the art. A detachable cap 32B is provided for covering the pump when not in use which cap is provided with a hook means 33A mounted adjacent or on the rim of its open end, as shown. This hook means functions in the manner discussed above in the description of the other embodiments of this invention.

FIGS. 14–16 disclose a hook-shaped means 35 for clamping over and partially surrounding a part of the rim 36 of a known can 37 of grooming material such as, for example, a can (pressurized or not) of shaving cream.

The hook-shaped means may be formed of resilient material such as rubber or plastic or formed of a suitable metallic material. This means comprises a support member 38 which has an arcuate hook-shaped indentation or portion 39 which extends along its top edge which portion is designed to surround and snuggly grasp or clamp to the rim 36 of can 37. A second leg-shaped portion 40 extends downwardly along the length of can 37. Extending laterally outwardly of support member 38 and substantially diametrically outwardly of the hook-shaped member 39 is a pair of hook-shaped arms 41 and 42. These arms are provided for supporting therebetween a safety razor 43 in the manner discussed above under the description of FIGS. 1–13.

This claimp is molded or extended to fit grooming containers found in the marketplace and if necessary, can be distorted so as to fit over those cans having rims of a slightly different arcuate configuartion than that normally assumed by the hook means when not mounted on a container.

FIG. 17 illustrates a modification of the hook means shown in FIGS. 14–16 wherein hook means 44 comprises a backing member 45 of a flat planar or arcuate configuration shown, for example, as having a square or rectangular shape that has an adhesive surface 46 covered when not in use by a tearaway paper cover 47. Extending laterally outwardly of the backing member 45 is a pair of integrally formed spacedly arranged arms or hooks 48 and 49. These hooks are arranged to support the head of a safety razor or toothbrush in the manner heretofore described.

The practical benefit of this embodiment is that the hook means 44 can be mounted at any position on any container of grooming material desired by the user.

FIGS. 18 and 19 disclose a further modification of the hook means shown in FIGS. 1–17 wherein a U-shaped band-like attachment means 50 is hown clamped around the top of an elongated cylindrical container of a grooming material such as a can 51 of (pressurized or not) pliable toothpaste material. The hook-like ends 52, 53 of the attachment means are spaced apart and arranged to support thereon the head 54 of a toothbrush 55 in the manner shown.

FIG. 20 illustrates a container 56 of toothpaste having formed integrally therewith a pair of spaced hook means 57, 58 for supporting thereon the head 54 of toothbrush 55 in the manner shown in FIG. 18.

FIG. 21 discloses a metallic, ceramic or plastic cylindrically shaped cup-like container 59 for supporting or housing therein a container 60 of grooming material. As shown, a pair of spaced hook-shaped means 61 and 62 are formed integrally therewith along the periphery of its open end 63 for supporting the head of a toothbrush or safety razor (not shown). This container 59 may be a decorative object serving a useful purpose as well as a pleasing addition to a bathroom counter.

Although but a few embodiments have been illustrated and described, it will be apparent to those skilled in the art that various changes and modifications may be made therein without departing from the spirit of the invention or from the scope of the appended claims.

What is claimed is:

1. An article of manufacture for supporting a grooming item such as a safety razor, toothbrush or the like on the outer periphery of an elongated vertically positioned container comprising:

hook means for attaching to the outer periphery of the elongated container, said hook means comprising a clamp for detachably engaging a rim of the container and a pair of spacedly arranged shanks of a common length extending outwardly of the container and each having a similar hook at its end curved to extend in a common direction for cradling and holding the head of a grooming item between the hooks and the container when the handle of the grooming item is positioned along the length of the container, said clamp comprising an arcuate-shaped leg portion extending along a part of the length of the container, and an arcuate-shaped indentation in one end of said leg portion opening outwardly thereof to partially surround a portion of a rim of the container, said indentation being formed on the same end of said clamp as said chanks but opening outwardly from the opposite side of said clamp.

2.The article of manufacture set forth in claim 1 wherein:

said hook means is formed of a resilient material.

3. An article of manufacture for supporting a grooming item such as a safety razor, toothbrush or the like on the outer periphery of an elongated vertically positioned container containing a grooming material comprising:

arcuate-shaped means for fitting at least partially around the elongated container and supported thereby, said means comprising a pair of spacedly arranged hook means of a common length extending laterally outwardly of the container in a common direction for cradling and holding the head of a grooming item when the handle of the item is positioned along the length of the container, said hook means comprising a pair of shanks, each having a hook at its end curved laterally thereof in a common upward direction for cradling and holding the head of a grooming item between the hooks and the container, and said arcuate-shaped means comprising a lip extending inwardly of the periphery of said means for fitting over the rim of the container.

4. The article of manufacture set forth in claim 3 wherein:

said arcuate-shaped means comprises a ring.

5. The article of manufacture set forth in claim 3 wherein :

said arcuate-shaped means comprises a ringshaped configuration of less than 360 degrees.

6. The article of manufacture set forth in claim 3 wherein:

said arcuate-shaped means comprises a ringshaped configuration of more than 180 degrees but less than 360 degrees.

7. The article of manufacture set forth in claim 5 wherein:

said arcuate-shaped means is formed of a resilient material.

8. The article of manufacture set forth in claim 7 wherein:

said arcuate-shaped means is formed of a plastic material.

9. The article of manufacture set forth in claim 7 wherein:

said arcuate-shaped means is formed of a metal.

* * * * *